United States Patent [19]

Schweiger

[11] Patent Number: 4,913,107

[45] Date of Patent: Apr. 3, 1990

[54] LIQUID-COOLING CIRCULATION SYSTEM FOR POWER AND WORKING MACHINES, ESPECIALLY INTERNAL COMBUSTION ENGINES

[75] Inventor: Erwin Schweiger, Dachau, Fed. Rep. of Germany

[73] Assignee: BMW, Munich, Fed. Rep. of Germany

[21] Appl. No.: 302,745

[22] PCT Filed: May 18, 1988

[86] PCT No.: PCT/EP88/00435

§ 371 Date: Jan. 18, 1989

§ 102(e) Date: Jan. 18, 1989

[87] PCT Pub. No.: WO88/09429

PCT Pub. Date: Dec. 1, 1988

[30] Foreign Application Priority Data

May 18, 1987 [DE] Fed. Rep. of Germany ..... 3716555

[51] Int. Cl.[4] ..... F01P 3/22

[52] U.S. Cl. ..... 123/41.54; 123/41.1; 236/34; 236/92 R

[58] Field of Search ..... 123/41.02, 41.03, 41.05, 123/41.08, 41.09, 41.10, 41.51, 41.54; 236/34, 34.5, 92 R

[56] References Cited

U.S. PATENT DOCUMENTS

| | | | |
|---|---|---|---|
| 4,002,442 | 1/1977 | Merz | 123/41.54 |
| 4,358,051 | 11/1982 | Hunt | 123/41.1 |
| 4,473,037 | 9/1984 | Michassouridis et al. | 123/41.1 |
| 4,510,893 | 4/1985 | Schweiger et al. | 123/41.54 |

*Primary Examiner*—Noah P. Kamen

*Attorney, Agent, or Firm*—Barnes & Thornburg

[57] ABSTRACT

A liquid cooling circulation system for power and working machines (especially internal combustion engines) contains an air-separating tank (17) in a by-pass vent line (14) which is arranged at the high point (5') of the radiator inflow (5). A fill inlet (19) with connecting openings (5'' and 17') to the radiator inflow (5) and air-separating tank (17) have a closure cover (20) which closes off these connecting openings with respect to one another. Excess pressure, vacuum and vent valves (21 and 22) are contained in the closure cover 20 which controls a line connection (25) to an atmospheric, or to an excess pressure expansion tank (27). A highly effective venting function in conjunction with an engine operation at strong rotational speed changes exists, since the line connection (25) is opened at least at low cooling medium temperature by means of a temperature-controlled vent valve (22). This arrangement and a small volume of the air-separating tank (17), allows for rapid filling and a reduced engine warm-up time.

43 Claims, 5 Drawing Sheets

LIQUID-COOLING CIRCULATION SYSTEM FOR POWER AND WORKING MACHINES, ESPECIALLY INTERNAL COMBUSTION ENGINES

BACKGROUND AND SUMMARY OF THE INVENTION

The invention relates to a liquid-cooling circulation system for power and working-machines (especially internal combustion engines) with an air-separating tank which lies in a by-pass vent line that extends from a high point in the radiator inflow fill line.

The air separating tank is provided at its high point with a fill inlet having a fill-in opening, a closure cover, and a line connected with a bottom area of an atmospheric expansion tank through excess pressure and vacuum relief valves each located in the closure cover. The excess pressure valve limits the pressure in the air-separating tank through a control line in the radiator inflow. The air-separating tank is arranged at the high point of the radiator inflow. The fill inlet includes connecting openings to the high points both of the radiator inflow and the air separating tank. The closure cover, in addition to closing the fill opening of the fill inlet, also closes the connecting openings with respect to one another. A throttle line connection is extended, as part of the by-pass vent line, from the high point of the radiator inflow to the bottom-near area of the air-separating tank.

The closure cover includes a direct control line between the connection opening of fill inlet and radiator inflow on one hand and the excess pressure valve limiting the pressure in the radiator inflow on the other. The excess pressure relief valve has an adjusting motor control diaphragm at the radiator inflow. A temperature-controlled venting valve is arranged in the line connection from the high point of the air-separating tank to the expansion tank and has a closing-shifting-temperature which lies below the thermostatically controlled normal operating temperature of the cooling medium. This ensures a conditioned cooling medium-pressure curve and cavitation free operation at the suction side of the cooling medium pump.

Furthermore, the invention relates to a liquid-cooling circulation system for power and working machines (especially internal combustion engines) with a fill inlet and a fill cover at a high point in the radiator inflow. An expansion tank is provided with a fill cover and an expansion and reservoir volume areas. Excess pressure and vacuum valves are provided in one of the two fill covers and there is a line extending from the high point of the fill inlet to the bottom area of the expansion tank. An air-separating tank is arranged at the fill inlet of the radiator inflow, which is located in a vent by-pass line that extends from a high point of the radiator inflow to the radiator return flow, and has a cross section throttle place between the radiator inflow and the air-separating tank. A high point of the vent line is connected to the line-connection from the fill inlet to the bottom area of the expansion tank.

Still further the invention contemplates having an air-separating tank which lies in a by-pass vent line extending from a high point in the radiator inflow to the radiator return flow. The high point includes a fill inlet with a fill-in opening and closure cover and is connected by an excess pressure and a vacuum valve (located in the closure cover) with the bottom area of an atmospheric expansion tank.

The vent line includes a throttling place ahead of the discharge into the air-separating tank. A temperature-controlled vent valve is arranged in the line connection from the high point of the air-separating tank to the expansion tank. Its actuating temperature lies below the thermostatically regulated normal-operating-temperature of the cooling medium for ensuring a pressure curve at the suction side of the cooling medium pump that provides cavitation-free operation thereof.

The invention also contemplates an atmospheric expansion tank which is series-connected to atmosphere, and wherein downstream of the excess pressure, vacuum and vent-valves the temperature-controlled vent valve is constructed at the same time as vacuum valve in the closure cover. This temperature-controlled vent valve has a valve body with a thermo-snap-spring that cooperates with a sealing ring acting as valve seat. The valve is acted upon by a spring and/or a float in the direction towards the sealing ring. The spring, float, valve body and sealing ring are arranged sequentially and coaxially, vertically one above the other in the valve body of the excess pressure valve. The temperature vent valve has a valve opening arranged parallel to the valve opening of the pressure valve.

The invention also contemplates having a heating by-pass circulation which branches off from a high-lying cooling jacket outlet and contains an electrical auxiliary pump and a heating arrangement for a vehicle. Here the auxiliary pump is adapted to be energized in dependence on a cooling medium and/or component minimum temperature existing in the engine.

A shifting valve directs the cooling medium leaving the engine cooling jacket to by-pass the heating arrangement and to be fed back into the cooling jacket through an inlet disposes opposite the outlet when the engine is turned off. The flow of the cooling medium through the cylinder head cooling jacket of internal combustion engines is so dimensioned that, a vapor bubble-detaching and-condensing intensity is assured at hot places.

In a known arrangement according to the DE-OS 32 267 508, corresponding to European Pat. No. 0-100 917, Japanese Pat. No. 59-23029 and U.S. Pat. No. 4,510,893, the air separating tank is connected to the suction side of the cooling medium pump by way of a return suction line which is used as a filling line. During filling, the cooling medium flows from the bottom area of the air-separating tank, by way of the return suction line to the low-lying cooling medium pump and from its bottom side into the cooling jacket of the engine. As the direct connection between cooling medium pump and return-water tank of the radiator is closed by a thermostat arranged in the radiator return line during the filling of a cold engine, the cooling medium can initially only flow into the cooling jacket and fill the same. However, this filling operation is delayed by the thermostat arrangements at the cooling jacket outlet and by the narrow interior cross section of the vent line from the radiator inlet to the fill inlet. This is true since the air to be displaced must escape exclusively out of the cooling jacket and out of the radiator. The low fill-velocity provided thereby not only increases the necessary filling time, but also the residual air-volume portions that remain in the cooling jacket and in other line sections. The cooling medium finally reaches the radiator only after the cooling jacket is completely filled. This is by way of the inflow line as a result of which, the filling velocity is further decreased and remaining residual air-volume portions are maintained in the radiator. An additional lengthy venting operation during running engine and removed closure cover is therefore necessary. Residual air which continues to remain in the cooling circulation system can be separated into the atmosphere by way of the expansion tank acting as air lock (after its precipitation out of the cooling medium solution at high temperature and after its collection at the excess pressure valves), when the excess pressure valve-opening values are exceeded. The advantages of an air-free cooling circulation system, such as steeper pressure build-up with increasing cooling medium temperature and reduced corrosion danger for the cooling circulation system components and the cooling medium itself cannot be obtained by reason of the extensive degassing. This is hardly effective, or at best considerably time-delayed, after numerous warm/cold cycles of the engine. Additionally, after a lengthy venting operation, no adequate pressure build-up of the cooling medium from the thermal-expansion thereof is available. By reason of the thermal-expansion of the cooling medium, which takes place prior to the closing of the closure cover without pressure build-up, the boiling limit (the pump cavitation limit) is then rapidly reached during the further rise of the operating temperature and an engine-overheating directly following operation at high load is unavoidable.

By contrast, an excess pressure (super-elevated in relation to relative low cooling medium temperature) occurs in the range where opening of the excess pressure valves occurs in the cooling circulation system of internal combustion engines. Here combustion gas-leakages penetrate into the cooling circulation system at high load and generally at low starting temperatures (especially at minus degrees) which are not adequately reduced during the cooling off of the engine in operating pauses. Additionally, the combustion gas-volume portions remaining in the cooling circulation system act destructively on the cooling medium additives as well as causing corrosion of the interior of the cooling circulation system components.

Finally, during the rapid turning off of the engine from high load, a strong local overheating of the cooling medium frequently occurs at hot spots in the cooling jacket. This causes corresponding high pressure vapor bubbles which may lead to strongly super-elevated pressure in the entire cooling circulation system. The consequence of this is: cooling medium discharge by way of the excess pressure valve; the overflow of the expansion tank; and the creation of insulating deposits in the cooling medium, especially water scale which attacks the system precisely at the hot places.

The task of the instant invention is to overcome the aforementioned described disadvantages within the range of the operating conditions-filling, venting, degassing, pump-cavitation, overheating, turn-off-after-heating, unnecessarily super-elevated progress of the cooling medium pressure in relation to the progress of the cooling medium temperature at low start, ambient temperatures and during penetration of combustion gases into the cooling circulation system. Also it is desired to reduce structural expenditure, costs, weight, component multiplicity, and incorrect operating possibilities. Furthermore, over-all dimensionings of cooling circulation components and of the cooling output, which heretofore have been standard of the compensation schemes used, are avoided.

The invention attains this in a surprisingly advantageous manner by having the air-separating tank arranged at the high point of the radiator inflow and the fill inlet include connecting openings to the high points both of the radiator inflow and the air separating tank. A closure cover, in addition to closing the fill opening of the fill inlet also closes the connecting openings with respect to one another.

A throttle line connection in a by-pass vent line is extended from the high point of the radiator inflow to the bottom-near area of the air-separating tank. The closure cover includes a direct control line between the connection opening of fill inlet (radiator inflow) and an adjusting motor of the excess pressure valve that limits the pressure in the radiator inflow.

A temperature-controlled venting valve is arranged in the line connection from the high point of the air-separating tank to the expansion tank and has a closing-shifting-temperature which lies below the thermostatically controlled normal operating temperature of cooling medium to provide the conditioned cooling medium-pressure curve at the suction side of the cooling medium pump for the cavitation-free operation thereof.

The filling of the cooling jacket and of the radiator is accelerated by such an assemblage. Also the residual air-inclusion is reduced because the cooling medium can flow from the fill-in opening equally and rapidly into the cooling jacket and into the radiator and the air can flow directly out in a counter-flow. Owing to the high cooling medium flow velocity, the residual air bubbles are taken along and only small residual air portions remain in the various cooling medium carrying lines and hollow spaces of the cooling circulation system. During the next operation of the engine, remaining residual components are flushed rapidly out of the inflow-high point into the air-separating tank by way of the vent line discharging out of the same. With arrangement of this discharge near the engine, a low-lying radiator arrangement for strongly dropping passenger motor vehicle front ends is thereby possible. Here the radiator in-flow drops off toward the radiator and an additional reduction of the cooling medium volume and a reduced warm-up time is thereby reached. This applies to an increased extent, compared to a normal connection of the vent line at the high point of cross-flow radiator inflow water tank.

At the same time venting, degassing and system pressure build-up as a function of temperature and rotational speed is improved by the temperature-controlled vent valve. Likewise cooling circulation pressure, super-elevated by reason of combustion gas leakages, is again reduced during cooling-off phases. The line connection (from the air-separating tank to the expansion tank) which is opened by the thermo-valve at low operating temperature, further enables a very simple venting operation after filling. With a closed closure cover, a continuous cooling medium residual air-outflow to the expansion tank, and cooling medium inflow into the air-separating tank is achieved during major engine rotational speed changes. This results from the rise of the pump-suction pressure at rotational speed reductions and the drop thereof at rotational speed increases.

In conjuction with a filling level indicator in the air-separating tank that includes a float chamber separate from the air-separating tank, which is line-connected at the bottom with the air separating tank and at the top with the valve chamber of the closure cover, continuing venting can occur at ever-increasing rotational speeds. This is true when the air-separating tank is arranged at the fill inlet of the radiator inflow, which in turn is located in a vent by-pass line from a high point of the radiator inflow to the radiator return flow and which has a cross section throttle place between radiator inflow and air-separating tank, and wherein its high point is connected to the line-connection from the fill inlet to the bottom area of the expansion tank. By having the closing temperature of the venting valve matched to the pressure build-up, dependent on the cooling circulation elasticity (hose-length and elasticity), or coolant temperature and/or pump rotational speed, avoids unnecessarily high cooling circulation system excess pressure values at relatively low cooling medium temperature values. It also assures an adequate spacing of the pump suction pressure curve with regard to the curve of the pump cavitation limit. A high pump feed output (as a result of high engine rotational speed in the shifting point of the thermo-valve) leads to a correspondingly higher starting pressure for the pressure build-up from the thermal expansion of the cooling medium during further temperature increase. This is due to the atmospheric pump suction pressure being strongly decreased in relation to the average cooling circulation system (excess pressure), but held constant by reason of the opened vent valve. As a result thereof, the chance of pump cavitation is additionally decreased during operation with relatively high rotational speeds.

By having all control elements located in the closure cover one obtains a compact cost and weight-favoable construction that facilitates servicing and repair.

By having the fill inlet terminate directly in a high point of the radiator inflow and the air-separating tank concentrically surrounding the fill inlet with a high point thereof connected to the valves in the closure cover by way of the connecting opening thereof and by having the radiator inflow pass through the air-separating tank within the area of the termination of the fill inlet, one obtains a particularly compact spatial coordination of the air-separating tank relative to the radiator inflow and to the filling inlet.

When the fill inlet and the radiator inflow are line-connected laterally, mutually intersect and/or extend through one another, and when the air-separating tank adjoins the fill inlet and the inflow line in the downward direction, one can obtain a compact construction. This is true if a hollow cylindrical insert, tightly adjoining the closure cover and the air-separating tank, is arranged in the connecting, intersecting and/or penetrating area of fill inlet and radiator inflow and when the interior space of the insert extends the air-separating tank upwardly to the bottom side of the closure cover and is connected by way of an opening in the bottom side of the closure cover and when the valves are located in the closure cover. Also the vent by-pass line should terminate in the interior space of the insert from the high point of the radiator inflow (by way of the unthrottled line-connection) when a throttle extends out of the bottom side of the closure cover through the insert and into the air-separating tank.

The insert is secured at the closure cover and contains a vent line section which concentrically adjoins an outlet opening of the closure cover and together with the interior space of the insert forms an air-return flow lock. This produces a further reduced structural expenditure because the by-pass-line portion in the air-separating tank is constructed completely in the closure cover and in the insert secured thereon. The insert thereby separates the air-separating tank from the radiator inflow and opens up the connection with a removed closure cover so that a simultaneous rapid filling and venting of the engine cooling jacket, radiator, and air-separating tank can take place.

Having the air-separating tank provided with a relatively large cross section hose-connecting nipple and a hose section adjoining the same, allows for volume expansion of the air-separating tank, as a result of which the dimensions and structural expenditure thereof are reduced.

By providing a cooling medium-level indicator in the air-separating tank, a safe filling level monitoring of an excess pressure cooling circulation system and a warning indication for operationally safe sufficient cooling medium content is possible. This is true because temperature-conditioned volume changes of the cooling medium already trigger a warning with a cold cooling circulation system, when the cooling medium warms-up during operation and exceeds the indicating level. Additionally, the filling level warning indication thereby forms a monitoring indication during the venting of the cooling circulation system after a new filling or refilling. More particularly, the pumping out of the residual air (by way of the expansion tank into the atmosphere) is possible by the simple measure of an operation of the engine with strong rotational speed change having an open line connection between the air-separating tank and expansion tank. This actuates, with dropping residual air volumes, a customary level warning light which is displaced continuously toward higher rotational speed and with unitary or separate construction of the level indicator housing with respect to the air-separating tank.

By having the cooling medium level transmitter include a float chamber that is separate from the air-separating tank and which is line-connected at the bottom with the air separating tank and at the top with the valve chamber of the closure cover, also provides a desired basic arrangement of the air-separating tank with fill inlet and filling cover at the high point of the radiator inflow. As a result, a large part of the advantages are achieved independently of the arrangement and construction of the excess pressure, vacuum/and vent-valves. Namely, advantageous filling and venting as well as rapid warm-up can be obtained. The valves can thereby be selected of any known or hereinabove proposed construction and arrangement, such as interconnection at the air-separating tank, at the expansion tank, or at both in series connection. With the two last-mentioned arrangements, an expansion tank with air expansion volume is required.

By having an excess pressure valve in the closure cover that is controlled by way of a control line by pressure in the reduction inflow, an additional control of an excess pressure valve by the pressure in the radiator inflow for the direct limiting of the pressure valve acting upon the radiator is possible. This is true when the valves are located in the radiator return flow and a fill inlet and a fill cover in the fill-in opening thereof at a high point in the radiator inflow; with an expansion tank having a fill-in cover, expansion and reservoir volume; with an excess pressure and vacuum valves in one of the fill covers; and with a line connection from the high point of the fill inlet to the bottom area of the expansion tank.

When a temperature-controlled vent valve with a closing-shifting-temperature is arranged in the line connection from the high point of the air-separating tank to the expansion tank and when the temperature lies below the thermostatically regulated normal-operating-temperature of the cooling medium, the pressure curve at the suction side of the cooling medium will provide for a cavitation-free pump operation. Apart from a slight additional structural expenditure and weight, this construction ensures the other functional advantages of the features of the invention previously indicated above. This is especially true in conjunction with an additional fill cover arranged in a known manner at the high point of the radiator inflow.

By having an atmospheric expansion tank series-connected to atmosphere downstream of excess pressure, vacuum and vent-valves; with the temperature-controlled vent valve constructed as a vacuum valve in the closure cover and with a valve body having a thermo-snap-spring that cooperates with a sealing ring as valve seat and valve opening and which is acted upon by a spring and/or a float in the direction toward the sealing ring; with the spring, float and sealing ring arranged sequentially and coaxially vertically one above the other in the valve body of the excess pressure valve; and with a valve opening arranged parallel to the valve opening thereof, one obtains ease of servicing and repair. Examination and/or exchange of the closure cover as a unit helps in this regard. Individual components which have long proved themselves in the motor vehicle technology are thereby used. The coordination of the components is facilitated because the snap spring is acted upon by the cooling medium temperature only after complete air discharge, so that the venting is favored by the cooling medium (even beyond reaching the closing-shifting temperature). A float in lieu of a closing spring is thus required only in particularly difficult venting conditions. The closed vent valve is assisted in its sealing function with increasing cooling medium pressure, because the thermo-snap-spring is thereby pressed more and more against the sealing ring.

By having a further vent line which starts from the high point of the radiator outlet water tank and terminates in the air-separating tank and which vent line includes at least one air/gas/temperature controlled vent/degassing valve which opens upon the pressure of air and/or gas during a predetermined warm-up temperature of the cooling circulation system, also assists in the filling and venting of the residual air to the air-separating tank. The tank, during filling, remains in the return flow of water to the cross flow radiators. However, a through-flow of cold cooling medium is prevented in the normal warm-up operation and thus an undesirable influence on the warm-up period is avoided. On the other hand, owing to the opening of the vent valve after the warm-up (at a cooling medium temperature lying above the ambient temperature, 60° in the return flow-water tank), combustion gas leakages, as well as residual air-volume parts (preferredly collecting therein), are immediately conducted away into the air-separating tank. They quickly flow out of the same by operation of an excess pressure valve and the expansion tank into the atmosphere (when the excess pressure in the cooling circulation system reaches the opening values of the excess pressure valve). Any leakage volume parts which possibly remain, are discharged (during the cooling-off of the cooling circulation system below the opening temperature of the vent valve) through the expansion tank and at the same time the cooling circulation system is thereby kept constantly at atmospheric pressure as long as the closing temperature of this temperature-controlled valve has not been reached. Vacuum in the cooling circulation system and penetration of air, conditioned thereby, (for example, by way of the seal of the cooling medium pump) is thereby additionally precluded.

By also having the vent/-degassing valve include a float as closure device, a thermo-snap-spring as a valve body and an O-sealing ring as valve-seat in this sequence and coaxially vertically one above the other in a valve chamber, provides for a functionally and structurally particularly advantageous construction of the vent-/degassing valve. Here there is a reverse temperature control with opening instead of closing by way of the shifting temperature of the valve. In lieu of the float and customary closing spring, a separate ball or flapper vent valve can be used as is customary in cooling medium thermostat valves.

By having the connection of the control line at the radiator inflow as a suction-jet-pump-like construction, such that excess pressure in the radiator inflow rising with increasing engine rotational speed (cooling medium pump-feed output) is introduced into the control line, enables an inflow pressure control to maintain the excess pressure valve in the closure cover even with excess pressure in the inflow area increasing with the pump feed output. Such is also maintained without separately matching the pressure control to the necessary highest excess pressure opening value that is possible. At the same time, the excess pressure valve can be constructed with the same excess pressure opening value for the inflow and return flow area. This additionally favors reduced structural expenditures and the number of closure covers necessary for different engines.

By having a further excess pressure temperature-dependent valve connected in series between the air separating and expansion tanks and with a closing shifting-temperature that lies above the thermostatically controlled normal operating temperature of the cooling medium (by virtue of the fact that the excess pressure valves have matched opening values) a desired temperature control is obtained. This is true since the closing temperature of the further excess pressure valve occurs at the highest engine rotational speed and excess pressure at the pump inlet has a sufficient spacing with respect to the pump cavitation limit. At the highest projected operating temperature condition reached, this value lies above the boiling pressure which (after turning off the engine from high load) corresponds to the locally occurring highest projected cooling medium temperature. This keeps the cooling medium pressure at relatively low level during normal operation and when combustion gas leakage is introduction into the cooling medium. Only with simultaneous high operating load and surrounding temperature does a shifting take place to the then necessary higher cooling medium pressure by the additional temperature excess pressure valve. Unnecessary high excess pressure loads of the cooling circulation system by reason of combustion gas leakages are avoided thereby and a continuous discharge of these combustion gas volume parts out of the cooling circulation system is achieved.

By having a manually actuatable vent arrangement in the line connection between air-separating tank and expansion tank (which valve is opened by a vent screw or a vent rotational position of the closure cover) provides for a cooling circulation system venting under particularly different conditions that are normal beyond the shifting temperature of a thermo-valve. The venting operation also limits itself to an operation of the engine with strongly changing rotational speeds (e.g. short turn-off pauses), so as to permit eventual air bubble accumulations at the pump inlet to press to the pump pressure side.

By having the expansion tank include a connection for a temporary pressure gas feed (above its fill level) to be conducted to the cooling medium level feed through the line connection to the air-separating tank, or through the vacuum, vent, and/or thermo-valves, allows for a corresponding pressure build-up. This prevents safe pressure overload of the expansion tank. To safeguard the projected operating excess of the cooling circulation system during servicing and/or repair operations, the cooling circulation system is closed at such a high cooling medium temperature so that the necessary pressure build up is no longer possible from thermal expansion of the cooling medium. This construction is particularly useful in conjunction with the manually actuatable venting arrangement recited Supra.

By having the expansion tank constructed with a pressure-resistence (approximately up to the middle cooling circulation system-operating pressure) and with an excess pressure safety valve, the fill cover of the expansion tank is then constructed as excess pressure safety valve at the expansion tank. Here a connecting nipple for a removable overflow hose serves as connection for the pressure gas supply. Compared to known cooling circulation systems the pressure strength of the expansion tank, the fastening of the associated filling cover and the dimensions of the connecting nipple for the associated overflow hose are the only components whose strength has to be specifically provided for.

An incorrect handling during the servicing of the cooling circulation system is precluded by having the air-separating tank and the expansion tank (as well as the fill covers thereof), arranged directly adjacent one another and by having the fill cover of the expansion tank cover the air-separating tank in the cover's closed position. Here an unintentional discharge of the cooling circulation excess pressure, by inadvertent opening of the associated closure cover (in lieu of the filling cover for the atmospheric expansion tank) is precluded. The closure cover is thereby accessible only when the filling cover is opened and removed for refilling. A removal of the closure cover by servicing personnel is then no longer to be expected. This is especially true in conjunction with the corresponding customary warning labelling of the closure cover. The structural expenditure of this measure includes a slight increase for a filling cover which can have a form and favorable coloring for the engine space styling.

The build-up of an excess pressure reaching the excess pressure opening value of the excess pressure valve (during the after-heating of the cooling medium after turning off the engine from high operating load) is avoided by having the auxiliary pump engaged with the hot turn-off of the engine in dependence on a cooling medium and/or a minimum temperature. A shifting valve is actuated to direct cooling medium leaving the cooling jacket (in lieu of vehicle interior heating arrangements), back into the cooling jacket through an inlet disposed opposite the outlet. The flow of the cooling medium through the cooling jacket is so dimensioned that a vapor bubble-detaching and condensing intensity is assured at hot places. In vehicles with already present heating circulation, the excess heating can be disapated by use of an auxiliary pump with a shifting valve. Vapor bubbles forming at the hot places are continuously slushed away by the cooling medium flow produced by the heating circulation auxiliary pump and are again condensed rapidly in the remaining cooling medium. A volume increase of the cooling medium in the circulation system which otherwise occurs is minimized. This effects an excess pressure in the entire cooling circulation system corresponding to the local cooling medium temperature and the associated boiling pressure. An excess expulsion of cooling medium through the excess pressure valve into the expansion tank and after overflow thereof is thus precluded.

Individual features of the invention art already known among the state of the art from numerous printed publications. Applicants combination thereof is neither suggested from these printed publications nor can it be derived therefrom without inventive activity. In particular, reference is made to the service instructions 1984 for the passenger motor vehicle—model Nissan ZX 300—model series Z31—pages LC-8/-13 and /18; to the DE-PS Nos. 25 09 995 and 28 17 976; to the DE-GM No. 19 31 736; to the GB-PS No. 1 415 698; to the EP-PS No. 0 101 339 as well as to U.S. Pat. Nos. 2,195,266; 3,047,235; 3,285,004; 4,167,159 and 4,489,883.

Other objects, advantages and novel features of the present invention will become apparent from the following detailed description of the invention when considered in conjunction with the accompanying drawings.

BRIEF DESCRIPTION OF THE DRAWINGS

Preferred embodiments are illustrated in the drawing.

DETAILED DESCRIPTION OF THE DRAWINGS

Figures 1, 3:
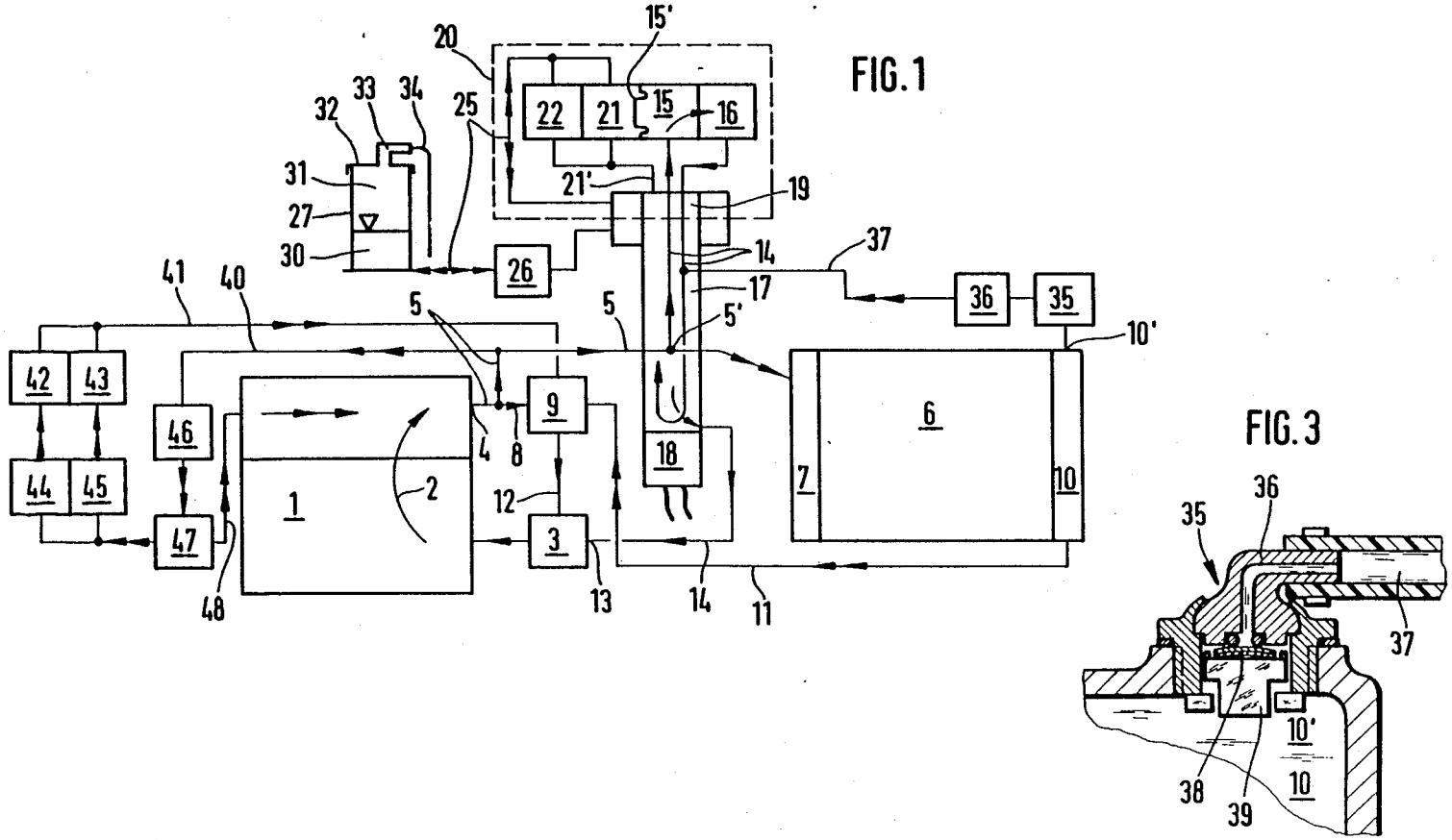
FIG. 1 shows a cooling circulation system for an internal combustion engine having heating circulation for a vehicle interior space.
FIG. 3 shows the high point connection of a return flow water line to a cross-flow radiator with vent valve according to FIG. 1.

An internal combustion engine 1 contains a cooling jacket 2, (arrow) into which cooling medium is fed under pressure by a cooling medium pump 3. A radiator return and fill inlet in-flow line has a free passage to a cross flow radiator 6 and connects a discharge 4 of the engine cooling jacket 2 to a inflow water tank 7 of the radiator. A by-pass 8 connects inlet line 5 to a mixing thermostat 9. An engine return line leads to the thermostat from the return-flow water tank 10 of the radiator 6. A pump suction line 12 connects the thermostat 9 with the suction side 13 of the pump 3.

A by-pass vent line 14 is connected to a high point 5' of the radiator return and fill line 5 as near to the engine as possible. This by-pass vent line 14 is unthrottled and located in an inflow pressure control chamber 15 and extends from there to a throttling place 16 that leads to a bottom area of an air-separating tank 17. To assure air separation an air termination discharge from the tank 17 is located opposite from the discharge of the by-pass vent line 14 that extends out of the bottom area that connects to the suction side 13 of the pump 3. An electrical level indicator 18 is arranged at the bottom side of the air separating tank 17. This indication is of customary construction and activates a warning instrument when an endangering air and/or gas accumulation occurs in the air separating tank 17.

Figure 2:
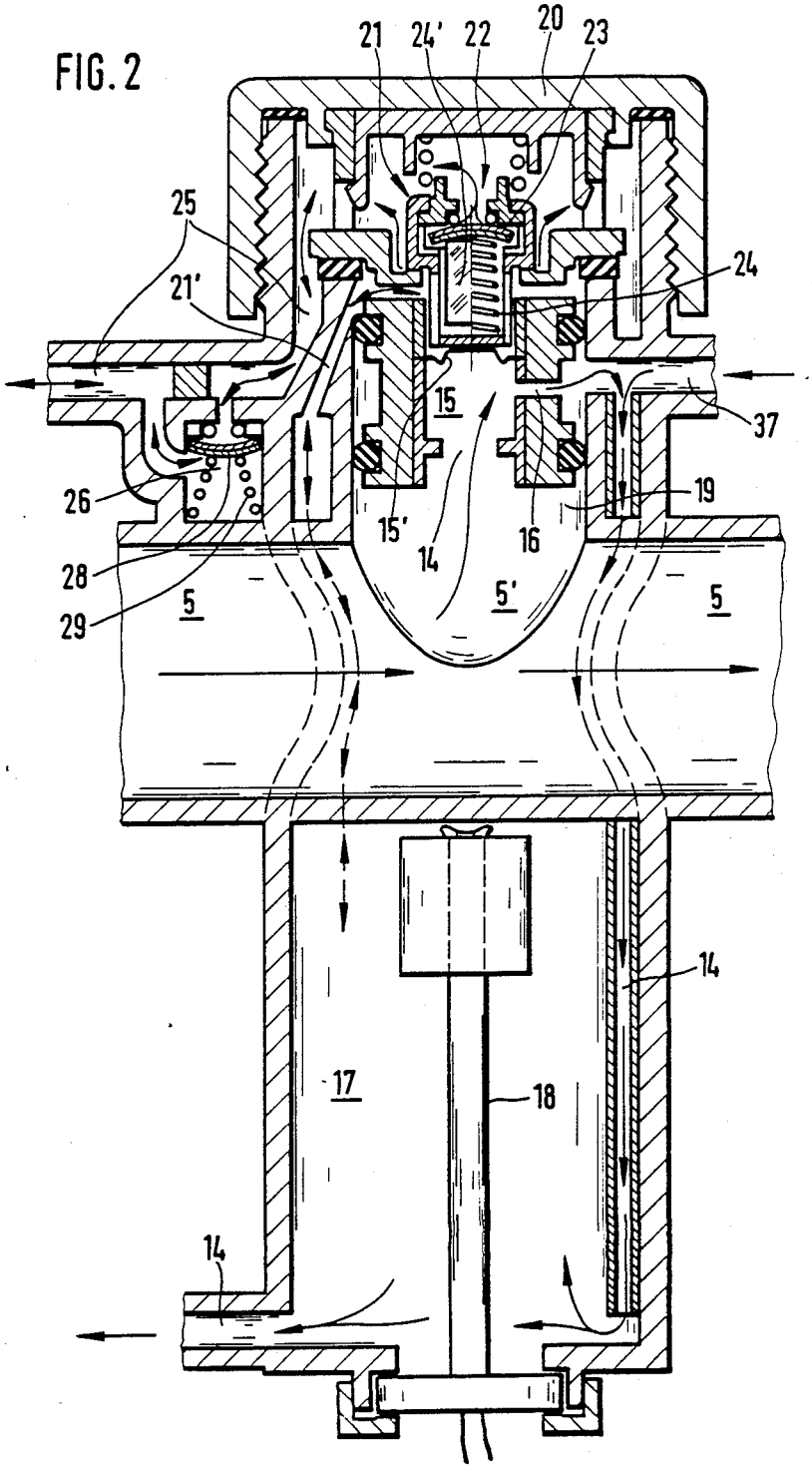
FIG. 2 shows a cooling system fill inlet according to FIG. 1 with closure cover and air separating tank in cross section.

The air separating tank coaxially surrounds the area of the high point 5' of the radiator inflow line 5 and rising by-pass vent line 14 is connected thereto (FIG. 2). The by-pass vent line 14 also acts as a fill inlet 19 for the cooling system and is arranged in part within a closure cover 20. The fill inlet 19, the control chamber 15 and the throttling place 16 (in the closure cover 20) as well as the line portion in the bottom area of the air separating tank 17, are all sequentially traversed by cooling water in the vent by-pass line 14. The customary excess pressure and vacuum valves 21 and 22 are arranged in the closure cover 20.

The excess pressure valve 21 is directly activated by excess pressure within the high point of the air-separating tank 17 by way of a line connection 21' and, indirectly by the excess pressure in the control chamber 15 by control diaphragm 15'. This excess pressure valve opens the line connection 21' (from the high point of the air separating tank 17) to the atmosphere.

Figure 4:
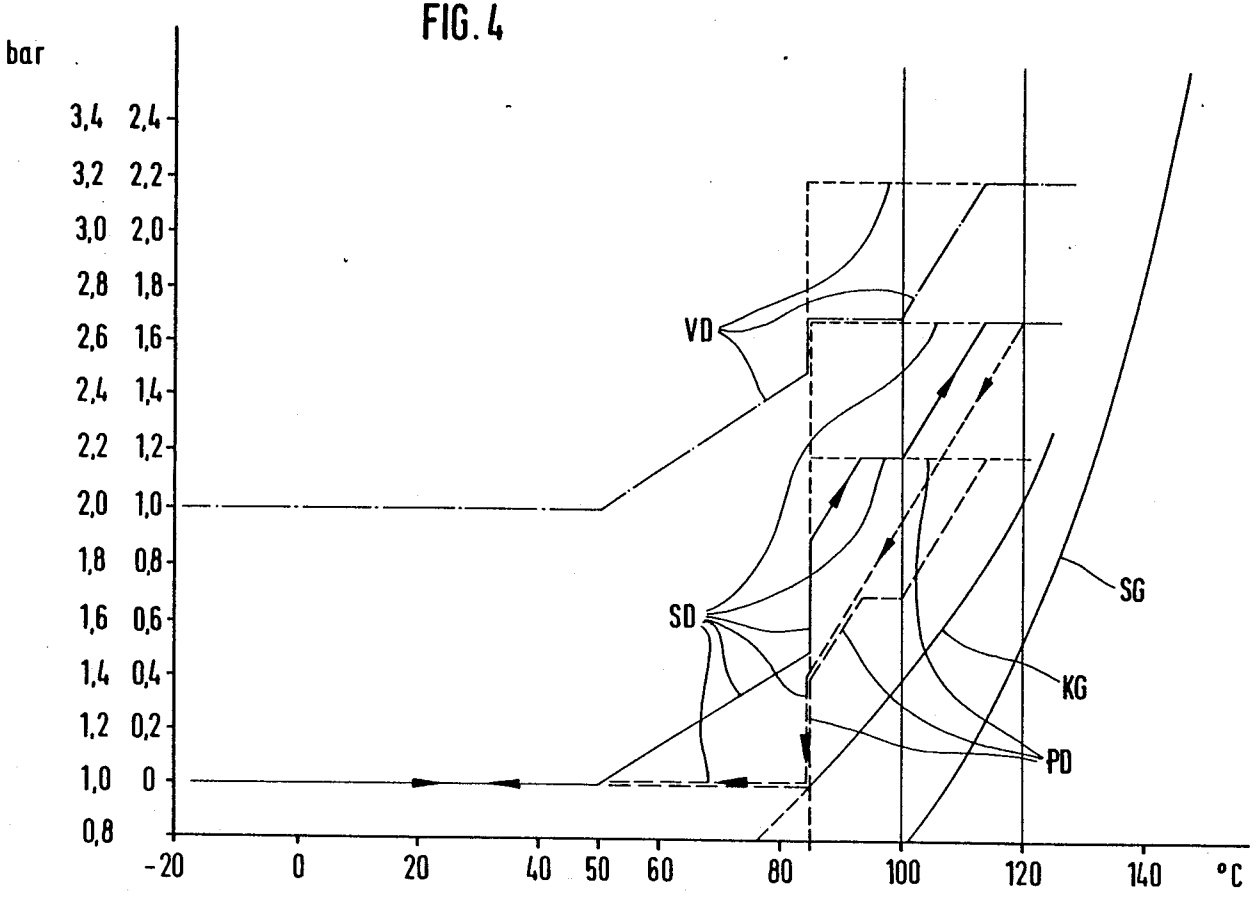
FIG. 4 shows a diagram of the temperature-dependent pressure curves in the cooling circulation system according to FIG. 1.

The vacuum valve 22 is built into the valve housing of the excess pressure valve 21 in a customary manner and is constructed at the same time as a temperature, and alternatively, as a float-controlled vent valve (FIG. 2). In addition to closing at a prevailing vacuum in the air separating tank 17, the vacuum valve 22 closes in response to the cooperation of a bimetal-snap-cup spring 23 with an O-ring seal and is biased by a spring 24 or a float 24'. Whenever the shifting temperature of the bimetal spring 23 is exceeded, the bimetal spring 23 is always shifted into closing position and the air-separating tank 17 is vented by the pressure differential across valve 22. The venting is thereby additionally favored. The float 21' can additionally vent tank 17 independently of the shifting condition of valve 22 as long as no pressure difference exists and this leads to still further residual venting. However, an excess pressure in the air separating tank keeps the bimetal spring 23 in its closed position in case there is a collection of air and/or combustion gas in the air-separating tank 17. As a result, a dangerous drop of the cooling medium pressure is precluded during the operation of the engine 1. During each cooling-off period, after a cold start with warm-up, a complete venting of the air-separating tank 17, and the entire cooling circulation system takes place. The bimetal spring 23 closes by reason of its shifting temperature (50° C. in FIG. 4) to replace the cooling medium (displaced out of the air-separating tank 17 by the vacuum valve 21) at a build-up of static system pressure SD, effective at idling rotational speed and turning off of the engine. This produces a curve of the lowest possible pump suction pressure PD at highest rotational speed in relation to the pump cavitation limit KG and to the cooling medium boiling point SG, by further thermal expansion of the cooling medium in cooperation with the elasticity of the entire cooling circulation system. In conjunction with proper dimensioning for the excess pressure valve 21 (known from DE-OS No. 32 26 508), both a dangerously low pump suction pressure PD and an unnecessarily high radiator inflow pressure VD are thus precluded.

A line connection 25 connects the excess and vacuum pressure valves 21 and 22 to atmosphere by way of a further temperature-controlled excess pressure valve 26 at a bottom area of an atmospheric expansion, reservoir and air lock container 27. This further excess pressure valve 26 contains a bimetal-snap-cup spring 28 which cooperates with an O-ring seal and is pressed against the seal by a cone spring 29 that determines the excess pressure opening value. The housing of this excess pressure valve 26 is so arranged in thermal connection with the inflow line 5 (and/or the housing of the air-separating tank 17) that the temperature of the cooling medium thereat acts upon the bimetal spring 28. The shifting temperature thereof is determined corresponding approximately to the upper limit of the regulating temperature range of the thermostat 9 (customarily about 90°–100° C.). The sum of the excess pressure values of the excess pressure valves 21 and 26 thus only becomes effective (FIG. 4) when the thermostat regulating range is exceeded, i.e., only when simultaneously high ambient temperature and high engine load occur. The cooling circulation system is therefore not unnecessarily loaded with super-elevated system pressure SD, inflow pressure VD and pump suction pressure PD due to combustion gas leakages at high engine load. Rather the combustion gas leakages are continuously directed to atmosphere by the first excess pressure valve 21 by way of the expansion tank 27.

The expansion tank 27 contains a cooling medium reserve 30 and an expansion volume 31. The fill cover 32 of the expansion tank 27 is equipped with a customary detent-bead fastening, which is so configured that at time of an excess pressure-valve-function at the expansion tank 27, disengagement of the cover 32 occurs. Excess pressure, [for example, one bar] at the expansion tank 27 can be used as a tire fill apparatus (like, an air pump) through overflow hose 34. Excessive pressure in the entire cooling system, can likewise be used via the connection of vacuum valve 21 with the expansion tank 27. The safety of the cooling circulation system can thus be assured in a simple cost-favorable manner after a closing of the cooling system and with an already existing operating temperature of the engine. This is especially true even after a lengthy venting operation or after a repair-conditioned pressure release with subsequent high load operation at high ambient temperature.

A further vent line 37 is connected to the by-pass vent line 14 at a high point 10' of the return flow water tank 10 of the cross flow radiator 6. This further vent connection forms a particularly effective air and leakage gas-collecting place for the radiator 6 by way of a vent valve 35 and a throttling place 36. The vent valve 35 consists of a bimetal-snap-cup spring 38 which cooperates with an O-ring seal and which is rendered operable and inoperable by a float 39 when cooling medium (air or combustion gas) exists at the high point 10'. The bimetal-cup spring 38 has a shifting temperature of about 60° C., so that a constant venting and de-gassing by-pass flow to the air-separating tank 17 exists at normal operating temperature of the cooling circulation system. During the engine warm-up, by contrast, the vent valve 35 is always closed after the discharge of air or combustion gas, so that the warm-up of the engine is not lengthened by a cooling action of this vent flow.

A vehicle-interior space-heating system provided with one left and one right heat-exchanger 42, 43, with one left and one right heat-regulating valve 44, 45, as well as with an electric heating system auxiliary pump 46 is connected in the usual manner to the cooling circulation system by way of a heating inflow 40 and return flow line 41. The heating inflow line 40 branches off from the radiator inflow line 5 and the heating return flow line 41 terminates at thermostat 9. A shifting valve 47 is arranged between the heating system-auxiliary pump 46 and the regulating valves 44 and 45. An electric control circuit (not shown) operates shifting valve 47 to connect the heating system-inflow line 40 to a cylinder head return line 48 when the engine 1 is turned off at high operating temperature. The cooling medium through-flow of the hot cylinder head, attainable thereby, immediately flushes away cooling medium-vapor bubbles occurring at hot places, to obtain condensation thereof in the further cooling medium stream. As a result, local vapor bubble accumulations with corresponding pressure build-up in the entire cooling circulation system as well as discharge of cooling medium conditioned thereby (in the extreme case overflow of the expansion tank 27) is avoided.

FIGS. 5 to 10 illustrate different coordination possibilities of the cooling circulation system-components according to the basic principle of the invention.

Figure 5:
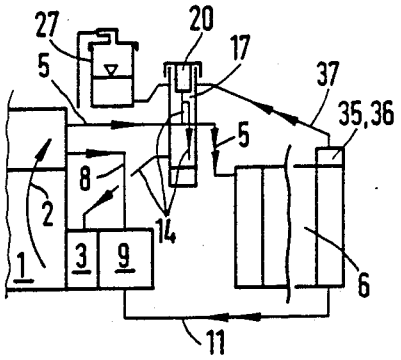
FIGS. 5–10 shows a plurality of several cooling circulation system-alternatives according to the invention in schematic representation.

In FIG. 5 the air-separating tank 17 is at the high point 51 of the radiator inflow 5. The atmospheric expansion tank 27 is provided as a separate item and the vent valve 35 at the return water tank 10 is illustrated corresponding to FIGS. 1 to 3.

Figure 6:
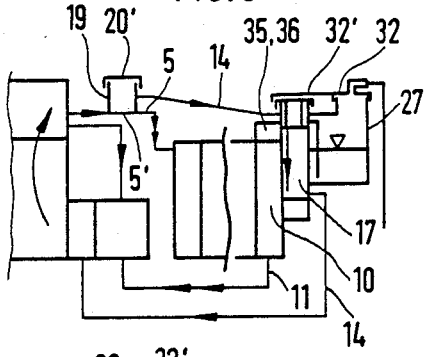

In FIG. 6, by contrast, the radiator inflow 5 is equipped with a fill inlet 19 and valveless closure cover 20' at its high point 5'. The air separating tank 17 is formed-on to the return water tank 10 and is combined with the expansion tank 27. The fill cover 32 thereof, includes a formed-on covering 32' for the closure cover 20 of the expansion tank 27 to preclude incorrect handling during refilling into the expansion tank 27. Thus an excess pressure loss with the cooling medium at operating temperatures is avoided.

Figure 7:
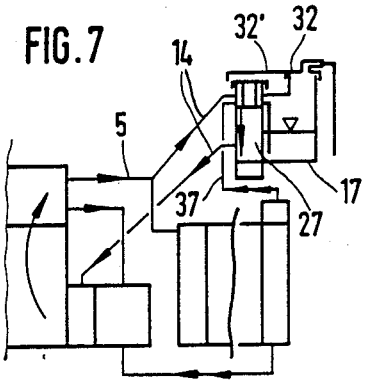

In FIGS. 7 to 10, the air-separating tank 17 and the atmospheric expansion tank 27 are combined in conformity with FIG. 6. However, they are separate and spaced from radiator 6. The by-pass vent line 14 is connected at the high point 5' of the radiator inflow 5 in (FIG. 7).

Figure 8:
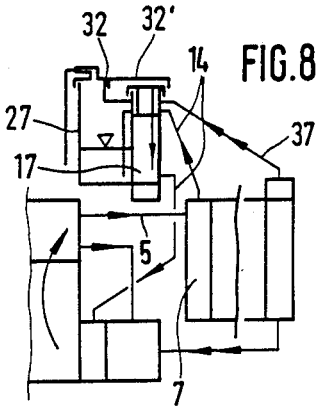
Figure 9:
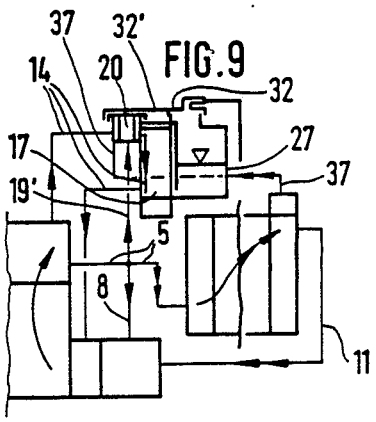
Figure 10:
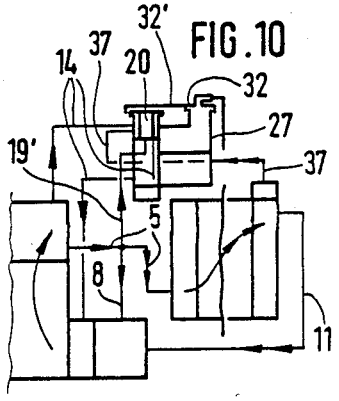

In FIG. 8 the connection is at the high point of the inflow water tank 7. In FIGS. 9 and 10 the connection is directly at a high point of the cooling jacket 2 of the engine 1.

In FIGS. 9 and 10, an additional fill line 19' is further branched off from the radiator inflow 5 and is closed off directly by the closure cover 20. A fill inlet 19 is thereby arranged (in FIG. 9) adjacent the air-separating tank 17 whereas in FIG. 10 the fill inlet 19' adjoins the closure cover 20 inside of the air-separating tank 17.

The hydraulic interconnection of the various elements of all embodiments conforms with FIGS. 1 to 3.

Figure 11:
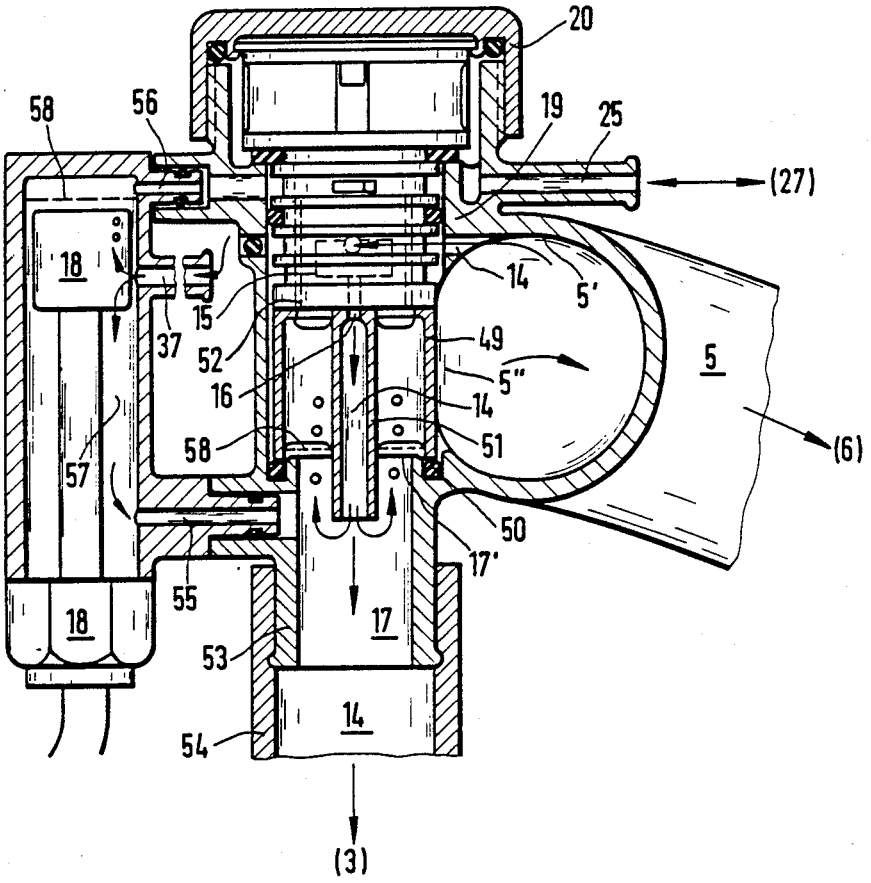
FIG. 11 shows an alternative cooling system fill inlet according to FIG. 1, in cross section.

In FIG. 11 (in contrast to FIG. 2), the radiator inflow line 5, as well as the air-separating tank 17 and the fill inlet 19, are not arranged coaxially and concentrically to one another but rather are laterally adjacent one another and mutually intersect one another. The fill inlet 19 may also be arranged centrally inside of a ring-shaped branched-off partial area of the radiator inflow 5. There the insert 49 closes an annularly shaped circumferential connecting opening between fill inlet 19 and radiator inflow 5. The fill inlet 19 terminates downwardly into the coaxial air-separating tank 17 and toward the side (into the radiator inflow 5). This allows for rapid filling of the large connecting openings 17' and 5''. These openings thus share a single removable closure cover 20. The closure cover 20, in addition to closing the fill-in opening of the fill inlet 19, also closes the connecting openings 17' and 5'' with respect to one another. For that purpose, the hollow cylindrical insert 49 is sealingly located at the bottom side of the closure cover 20 and is supported with its lower end face by an O-sealing ring 50 situated at the upper edge of the air-separating tank 17. The interior of the insert 49 extends the air-separating tank 17 upwardly toward the bottom side of the closure cover 20. The interior construction of the closure cover 20 agrees with that according to FIG. 2. However, the inflow pressure-control chamber 15 is traversed in a reverse direction from the outside out of the high point 5' of the radiator inflow 5 radially-inwardly and axially-downwardly through the corresponding throttling place 16. A part of the by-pass flow vent line 14 is constructed in one piece as coaxial tubular member 51 in the insert 49. The bottom side of the closure cover 20 is connected by way of radially distributed openings 52 with its inwardly disposed excess pressure and vacuum valves 21 and 22 (FIG. 2). This allows air and gas accumulations to always flow off through the valve openings from the high point of the air-separating tank 17. A relatively large cross section hose-connecting nipple 53 is formed-on at the bottom side of the air-separating tank 17, and connected to a hose 54 to increase and improve the volume of the air-separating tank 17 and therewith also its function.

A float chamber 57 of an electrical cooling medium level transmitter 18 is connected at the bottom to the air-separating tank 17 by lateral connections 55 and 56 and at the top to the valves 21 and 22 in the closure cover 20. A further vent line 37, which starts from the return flow water tank 10 of the cross flow radiator 6 (FIGS. 1 and 3), can be connected in a simple manner with the float chamber 57 since such is also suitable to effectively vent and de-gas by reason of its connections. In addition to the illustrated plug-in connections 55 and 56, a unitary construction of the fill inlet 19, the air-separating tank 17 and the radiator inflow partial member 5 is advantageously obtained.

For protection against function-failures of the valves 21 and 22 in the closure cover 20, fine sieves 58 are arranged at the bottom side of the insert 50 and in the upper areas of the float chamber 57. Those sieves are contacted by the cooling medium flowing in and out through the valves 21 and 22 and thus are not subjected to any unnecessary dirt impact from the circulating cooling medium.

Differing from the hydraulic connection according to the block diagram according to FIG. 1, the fill cover 32 of the expansion tank 27 can also be equipped with a corresponding excess pressure and vacuum valves. This replaces the valves 21 and 22 in the closure cover 20 of the fill inlet 19. Alternatively they can be connected in series so that an excess pressure expansion tank with air cushion results. The manner of operation of the air-separating tank 17 with improved filling and venting as well as reduced warm-up of the engine cooling circulation system is thus obtained.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A liquid-cooling circulation system for power-and working-machines, especially internal combustion engines, comprising radiator means, radiator inflow and return-flow means operatively connected with the radiator means, a by-pass vent line means extending from a high point in the radiator inflow means to the radiator return-flow means, air-separating tank means in said by-pass vent line means, said air-separating tank means including at its high point a fill inlet means having a fill opening ane a closure cover means, an atmospheric expansion tank means, the high point of the air separating tank means being operatively connected with the bottom area of the expansion tank means by way of an excess pressure valve means and a vacuum valve means in the cover means, at least one excess pressure valve means limiting the pressure in the air-separating tank means and in the radiator inflow means by means of a control line, the air-separating tank means being arranged substantially at the high point of the radiator inflow means, the fill inlet means being provided with connecting openings to the high points of the radiator inflow means as also of the air-separating tank means, the closure cover means, in addition to closing the fill opening of the fill inlet means, also closing the connecting openings with respect to each other, a throttled line-connection extending from the high point of the radiator inflow means to the bottom-near area of the air-separating tank means as part of the by-pass vent line means, the closure cover means including a direct line connection as control line between the connecting opening from the fill inlet means and radiator inflow means, on the one hand, and the excess pressure valve means limiting the pressure in the radiator inflow means, respectively, its adjusting motor means, on the other, and a temperature-controlled vent valve means arranged in the line connection from the high point of the air-separating tank means to the expansion tank means, said temperature-controlled vent valve means having a closing shifting temperature that lies below the thermostatically regulated normal operating temperature of the cooling medium and commencing with which the thermal expansion-, elasticity-and pump operation-conditioned cooling medium-pressure curve at the suction side of the cooling medium pump means assures the cavitation-free operation thereof.

2. A cooling circulation system according to claim 1, wherein the fill inlet means terminates directly in a high point of the radiator inflow means, the air-separating tank means concentrically surrounding the fill inlet means and the high point of which being operatively connected with the valve means in the closure cover means by way of the connecting opening thereof, and the radiator inflow means extending through the air-separating tank means within the termination of the fill inlet means.

3. A cooling circulation system according to claim 1, wherein the fill inlet means and the radiator inflow means are line-connected laterally, mutually intersect and/or extend through one another, the air-separating tank means adjoining the fill inlet means and the inflow line means in a downward direction, a hollow cylindrical insert means sealingly adjoining the closure cover means and the air-separating tank means being arranged in the connecting-, intersecting and/or penetrating area of the fill inlet means and radiator inflow means, the interior space of the insert means extending the air-separating tank means in the upward direction toward the bottom side of the closure cover means and being operatively connected by way of an opening in the bottom side of the closure cover means with the valve means in the closure cover means, and the vent by-pass line means terminating in the interior space of the insert means, which terminates in the closure cover means from the high point of the radiator inflow means by way of the unthrottled line connection as control line and which discharges out of the same throttled at the bottom side of the closure cover means into the insert means, respectively, into the air-separating tank means.

4. A cooling circulation system according to claim 3, wherein the insert means is secured at the closure cover means and includes concentrically a vent line section which adjoins an outlet opening of the closure cover means and together with the interior space of the insert means, respectively, with the air-separating tank means forms an air return flow lock.

5. A cooling circulation system according to claim 4, wherein said last-mentioned outlet opening forms a throttling means.

6. A cooling circulation system according to claim 1, wherein the air-separating tank means extends with relatively large cross section in a hose-connecting nipple and in a hose section adjoining the same.

7. A cooling circulation system according to claim 1, wherein the air-separating tank means includes a cooling medium-level transmitter means.

8. A cooling circulation system with a valve chamber in the closure cover means according to claim 7. wherein the cooling medium level transmitter means includes a float chamber separate from the air-separating tank means which, at the bottom is operatively connected with the air-separating tank means and at the top with the valve chamber of the closure cover means.

9. A cooling circulation according to claim 1, wherein a further vent line means terminates in the air-separating tank means, which starts from the high point of a radiator outlet tank and includes at its connection thereat at least on air-/gas-controlled vent-/degassing valve means, on the one hand, and temperature-controlled vent-/degassing valve means, on the other, said last-mentioned valve means opening in case of air and-/or gas presence, respectively, beginning with a predetermined warm-up temperature of the cooling circulation system.

10. A cooling circulation system according to claim 9, wherein the last-mentioned valve means includes a float as closure member, a thermo-snap-spring as valve body and and O-sealing ring as valve seat and valve opening in this sequence arranged coaxially vertically one above the other in a valve chamber.

11. A cooling circulation system according to claim 1, wherein the connection of the control line at the radiator inflow means includes a suction jet pump-like constructin in such a manner that the excess pressure in the radiator inflow means which rises with increasing engine rotational speed, respectively, cooling medium pump feed output is introduced into the control line deliberately changed.

12. A cooling circulation system according to claim 1, comprising a furhter temperature-dependent closing excess pressure valve means connected in series with respect to the excess pressure valve means in the line connection between the air-separating tank means and the expansion tank means, the closing temperture of the further excuss pressure valve means lying above the thermostatically regulated normal operating temperature of the cooling medium, the excess pressure valve means having such matched opening values that at the closing temperature of the further excess pressure valve means and at the same time highest engine rotational speed, respectively, pump feed output, the excess pressure at the pump inlet has an adequate spacing with respect to the pump cavitation limit, and wherein at highest projected operating temperature the aforementioned condition is achieved by the addition-opening value of the excess pressure value means and said value lies above the boiling point that corresponds to the locally occurring highest projected cooling medium temperature after turning off the engine from high load.

13. A cooling circulation according to claim 1, wherein the line connection between the air-separating tank means and the expansion tank means includes a manually actuatable venting means which in its venting position opens by means of one of a venting screw or a venting rotational position of the closure cover means, one of the excess pressure-, vacuum-, venting- and/or thermo-valve means, respectively a vent opening disposed in parallel thereto.

14. A cooling circulation system according to claim 13, wherein the expansion tank means includes above its filling level range a connection for a temporary pressure-gas supply attributable to the cooling medium level, which effects a cooling medium feed by way of the line connection to the air-separating tank means and through the vacuum-, venting and/or thermo-valve means, respectively, the vent opening into the cooling circulation system with corresponding pressure build up in the same.

15. A cooling circulation system according to claim 14, wherein the expansion tank means is constructed pressure-resistant corresponding up to about the middle cooling circulation operating pressure and has an excess pressure safety valve.

16. A cooling circulation system according to claim 15, wherein the fill cover means of the expansion tank means is constructed as excess pressure safety valve, the fastening thereof at the expansion tank means being matched to its disengagement at super-elevated pressure value, and a connecting nipple for a hose adapted to be pulled off serving as connection for the pressure gas supply.

17. A cooling circulation system according to claim 1, wherein the expansion tank means includes above its filling level range a connection for a temporary pressure-gas supply attributable to the cooling medium level, which effects a cooling medium feed by way of the line connection to the air-separating tank means and through the vacuum-, venting and/or thermo-valve means, respectively, the vent opening into the cooling circulation system with corresponding pressure build up in the same.

18. A cooling circulation system according to claim 17, wherein the expansion tank means is constructed pressure-resistant corresponding up to about the middle cooling circulation operating pressure and has an excess pressure safety valve.

19. A cooling circulation system according to claim 18, wherein the fill cover means of the expansion tank means is constructed as excess pressure safety valve, the fastening thereof at the expansion tank means being matched to its disengagement at super-elevated pressure value, and a connecting nipple for a hose adapted to be pulled off serving as connection for the pressure gas supply.

20. A cooling circulation system according to claim 1, wherein the air-separating tank means and the expansion tank means as well as the fill cover means thereof are arranged directly adjacent one another, and wherein the fill cover means of the expansion tank means covers in its closing position that of the air-separating tank means.

21. A cooling circulation system according to claim 1, wherein a heating by-pass circulation means, which branches off from a high lying cooling jacket outlet includes an electric auxiliary pump means and a heating means, the auxiliary pump means being operable to be engaged during a hot turn-off of the engine in dependence on a cooling medium and/or component minimum temperature existing thereby, a shifting valve means operable to be actuated thereby substantially at the same time deflecting the cooling medium leaving the cooling jacket, in lieu of into the heating means, back into the cooling jacket by way of an inlet disposed opposite the outlet, and the flow of the cooling medium through the cooling jacket being so selected that a vapor bubble detaching and condensing intensity is assured at hot places.

22. A cooling circulation system according to claim 21, wherein the flow of the cooling medium controlled by the shifting valve means is through the cylinder head cooling jacket of internal combustion engines.

23. A cooling circulation system according to claim 1, wherein the radiator inflow means extends from an engine cooling jacket to a radiator inflow water header, and the return flow means extends from a radiator outlet header to the suction side of the cooling pump means.

24. a liquid cooling circulation system for power-and working-machines, especially internal combustion engines according to claim 1, further comprising an atmospheric expansion tank means, excess pressure-, vacuum- and vent-valve means, said expansion tank means being connected downstream of said valve means in the direction toward the atmosphere, the temperature-controlled vent valve means being constructed at the same time as vacuum valve means in the closure cover means whose valve body forms a thermo-snap-spring, cooperates with a sealing ring as valve seat and valve opening and being acted upon by one of a spring and a float in the direction toward the sealing ring, the spring or float, the valve body and the sealing ring being arranged in this sequence coaxially vertically one above the other in the valve body of the excess pressure valve means with a valve opening arranged in parallel to the valve opening thereof.

25. A liquid-cooling circulation system for power-and working-machines, especially internal combustion engines, comprising radiator inflow means, a fill inlet means and a fill cover means in the fill-in opening thereof at a high point in the radiator inflow means, an expansion tank means with a fill cover means and with expansion and reservoir volumes, excess pressure and vacuum valve means in one of the fill cover means, a line connection from the high point of the fill inlet means to the bottom area of the expansion tank means, an air-separating tank means arranged at the fill inlet means of the radiator inflow means, said air-separating tank means being located in a vent by-pass line means from a high point of the radiator inflow means to a radiator return flow means and having a cross-sectional throttling means between radiator inflow means and air-separating tank means, and the high point of the air-separating tank means being operatively connected with the line connection from the fill inlet means to the bottom area of the expansion tank means.

26. A cooling circulation system according to claim 25, wherein an excess pressure valve means in the closure cover means is controlled by way of a control line by the pressure in the radiator inflow means.

27. A cooling circulation system according to claim 26, wherein the connection of the control line at the radiator inflow means includes a suction jet pump-like construction in such a manner that the excess pressure in the radiator inflow means which rises with increasing engine rotational speed, respectively, cooling medium pump feed output is introduced into the control line deliberately changed.

28. A cooling circulation system according to claim 25, wherein a further vent line means terminates in the air-separating tank means, which starts from the high point of a radiator outlet tank and includes at its connection thereat at least an air-/gas-controlled vent-/degassing valve means, on the one hand, and temperature-controlled vent-/degassing valve means, on the other, said last-mentioned valve means opening in case of air and-/or gas presence, respectively, beginning with a predetermined warm-up temperature of the cooling circulation system.

29. A cooling circulation system according to claim 28, wherein the last-mentioned valve means includes a float as closure member, a thermo-snap-spring as valve body and and O-sealing ring as valve seat and valve opening in this sequence arranged coaxially vertically one above the other in a valve chamber.

30. A cooling circulation system according to claim 25, wherein the air-separating tank means and the expansion tank means as well as the fill cover means thereof are arranged directly adjacent one another, and wherein the fill cover means of the expansion tank means covers in its closing position that of the air-separating tank means.

31. A cooling circulation system according to claim 25, wherein a heating by-pass circulation means, which branches off from a high lying cooling jacket outlet includes an electric auxiliary pump means and a heating means, the auxiliary pump means being operable to be engaged during a hot turn-off of the engine in dependence on a cooling medium and/or component minimum temperature existing thereby, a shifting valve means operable to be actuated thereby substantially at the same time deflecting the cooling medium leaving the cooling jacket, in lieu of into the heating means, back into the cooling jacket by way of an inlet disposed opposite the outlet, and the flow of the cooling medium through the cooling jacket being so selectd that a vapor bubble detaching and condensing intensity is assured at hot places.

32. A liqiud cooling circulation system for power and working-machines, especially internal combustion engines, comprising radiator inflow and return flow means, an air-separating tank means operatively connected in a by-pass vent line means from a high point in the radiator inflow means to the radiator return flow means, said air-separating tank means including at its high point a fill inlet means having a fill-in opening and a closure cover means, the high point of the air-separating tank means being operatively connected by way of an excess pressure valve means and vacuum valve means in the closure cover means with the bottom area of an atmospheric expansion tank means, the vent line means including throttling means ahead of the discharge in the air-separating tank means, a temperature-controlled vent valve means being arranged in the line connection from the high point of the air-separating tank means to the expansion tank means, said vent valve means having a closing shifting temperature which lies below the thermostatically regulated normal operating temperature of the cooling medium and commencing with which the thermal expansion-, elasticity and pump operationally-conditioned cooling medium-pressure curve at the suction side of a cooling pump means assures the cavitation-free operation thereof.

33. A cooling circulation system according to claim 32, comprising a further temperature-dependent closing excess pressure valve means connected in series with respect to the excess pressure valve means in the line connection between the air-separating tank means and the expansion tank means, the closing temperature of the further excess pressure valve means lying above the thermstatically regulated normal operating temperature of the cooling medium, the excess pressure valve means having such matched opening values that at the closing temperature of the further excess pressure valve means and at the same time highest engine rotational speed, respectively, pump feed output, the excess pressure at the pump inlet has an adequate spacing with respect to the pump cavitation limit, and wherein at highest projected operating temperature the aforementioned condition is achieved by the addition-opening value of the excess pressure valve means and said value lies above the boiling point that corresponds to the locally occurring highest projected cooling medium temperature after turning off the engine from high load.

34. A cooling circulation system according to claim 32, wherein the line connection between the air-separating tank means and the expansion tank means includes a manually actuatable venting means which in its venting position opens by means of one of a venting screw or a venting rotational position of the closure cover means, one of the excess pressure-, vacuum-, venting- and/or theremo-valve means, respectively a vent opening disposed in parallel thereto.

35. A cooling circulation system according to claim 32, wherein the expansion tank means includes above its filling level range a connection for a temporary pressure-gas supply attributable to the cooling medium level, which effects a cooling medium feed by way of the line connection to the air-separating tank means and through the vacuum-, venting-and/or thermo-valve means, respectively, the vent openting into the cooling circulation system with corresponding pressure build up in the same.

36. A cooling circulation system according to claim 35, wherein the expansion tank means is constructed pressure-resistant corresponding up to about the middle cooling circulation operating pressure and has an excess pressure safety valve.

37. A cooling circulation system according to claim 35, wherein the fill cover means of the expansion tank means is constructed as excess pressure safety valve, the fatening thhereof at the expansion tank means being matched to its disengagement at super-elevated pressure value, and a connecting nipple for a hose adapted to be pulled off serving as connection for the pressure gas supply.

38. A liquid cooling circulation system for power-and working-machines, especially internal combustion engines according to claim 32, further comprising an atmospheric expansion tank means, excess pressure-, vacuum- and vent-valve means, said expansion tank means being connected downstream of said valve means in the direction toward the atmosphere, the temperature-controlled vent valve means being constructed at the same time as vacuum valve means in the closure cover means whose valve body forms a thermo-snap-spring, cooperates with a sealing ring as valve seat and valve opening and being acted upon by one of a spring and a float in the direction toward the sealing ring, the spring or float, the valve body and the sealing ring being arranged in this sequence coaxially vertically one above the other in the valve body of the excess pressure valve means with a valve opening arranged in parallel to the valve opening thereof.

39. A cooling circulation system according to claim 32, wherein a further vent line means terminates in the air-separating tank means, which starts from the high point of a radiator outlet tank and includes at its connection thereat at least an air-/gas-controlled vent-/degassing valve means, on the one hand, and a temperature-controlled vent-/degassing valve means, on the other, said last-mentioned valve means opening in case of air and/or gas presence, respectively, beginning with a predetermined warm-up temperature of the cooling circulation system.

40. A cooling circulation system according to claim 39, wherein the last-mentioned valve means includes a float as closure member, a thermo-snap-spring as valve body and an O-sealing ring as valve seat and valve opening in this sequence arranged coaxially vertically one above the other in a valve chamber.

41. A cooling circulation system according to claim 32, wherein the air-separating tank means and the expansion tank means as well as the fill cover means thereof are arranged directly adjacent one another, and wherein the fill cover means of the expansion tank means covers in its closing position that of the air-separating tank means.

42. A cooling circulation system according to claim 32, wherein a heating by-pass circulation means, which branches off from a high lying cooling jacket outlet includes an electric auxiliary pump means and a heating means, the auxiliary pump means being operable to be engaged during a hot turn-off of the engine in dependence on a cooling medium and/or component minimum temperature existing thereby, a shifting valve means operable to be actuated thereby substantially at the same time deflecting the cooling medium leaving the cooling jacket, in lieu of into the heating means, back into the cooling jacket by way of an inlet disposed opposite the outlet, and the flow of the cooling medium through the cooling jacket being so selected that a vapor bubble detaching and condensing intensity is assured at hot places.

43. A liquid cooling circulation system for power- and working-machines, especially internal combustion engines, comprising an atmospheric expansion tank means, excess pressure-, vacuum- and vent-valve means, said expansion tank means being connected downstream of said valve means in the direction toward the atmosphere, the temperature-controlled vent valve means being constructed at the same time as vacum valve means in the closure cover means whose valve body forms a theremo-snap-spring, cooperates with a sealing ring as valve seat and valve opening and being acted upon by one of a spring and a float in the direction toward the sealing ring, the spring or float, the valve body and the sealing ring being arranged in this sequence coaxially vertically one above the other in the valve body of the excess pressure valve means with a valve opening arranged in parallel to the valve opening thereof.

* * * * *